US008348706B2

(12) United States Patent
Yu et al.

(10) Patent No.: US 8,348,706 B2
(45) Date of Patent: Jan. 8, 2013

(54) POWER CONTACT AND POWER CONNECTOR HAVING THE SAME

(75) Inventors: Wang-I Yu, Jhonghe (TW); Hung-Chi Tai, Jhonghe (TW); Yung-Ghih Hung, Jhonghe (TW); Chun-Jen Cheng, Jhonghe (TW)

(73) Assignee: Alltop Electronics (Suzhou) Co., Ltd., Taicang, Jiangsu Province (CN)

( * ) Notice: Subject to any disclaimer, the term of this patent is extended or adjusted under 35 U.S.C. 154(b) by 0 days.

(21) Appl. No.: 13/046,473

(22) Filed: Mar. 11, 2011

(65) Prior Publication Data

US 2012/0178314 A1 Jul. 12, 2012

(30) Foreign Application Priority Data

Jan. 11, 2011 (CN) ..... 2011 1 0004541

(51) Int. Cl.
*H01R 4/36* (2006.01)

(52) U.S. Cl. ..... 439/814; 439/737

(58) Field of Classification Search ..... 439/692, 439/695, 737, 106, 810–814
See application file for complete search history.

(56) References Cited

U.S. PATENT DOCUMENTS

| | | | | |
|---|---|---|---|---|
| 4,080,036 | A * | 3/1978 | Hagel | 439/692 |
| 4,213,667 | A * | 7/1980 | Wittes | 439/469 |
| 5,052,946 | A * | 10/1991 | Homolka | 439/584 |
| 5,399,098 | A * | 3/1995 | Marshall et al. | 439/398 |
| 7,976,352 | B2 * | 7/2011 | Nishimura | 439/814 |

* cited by examiner

*Primary Examiner* — Phuong Dinh
(74) *Attorney, Agent, or Firm* — Sughrue Mion, PLLC

(57) ABSTRACT

A power contact includes a base, a mating conductor including a mating portion electrically mating with a mating power contact and an opposite mounting portion, and a fixing member for fixing the mating conductor and the base together. The base defines a mounting hole extending along a first direction and a fixing hole in communication with the mounting hole and extending along a second direction perpendicular to the first direction. The mounting portion is inserted into the mounting hole, and defines an opening hole extending along the second direction. The fixing member is inserted into the opening hole and the fixing hole to fix the mating conductor and the base together.

16 Claims, 9 Drawing Sheets

POWER CONTACT AND POWER CONNECTOR HAVING THE SAME

BACKGROUND OF THE INVENTION

1. Field of the Invention

The present invention relates to a power contact, a power connector and a power connector assembly, more particularly to a power contact and a power connector having the same connecting with a power cable.

2. Description of Related Art

Electrical connectors are widely used today. In general, electrical connectors can be classified as desktop connectors, laptop connectors, consuming connectors, and other types. Power connector assembly is one common kind electrical connector assembly used in different equipments. Please refer to FIG. 1, a conventional power connector assembly comprises a power connector and a number of power cables 210' connected with the power connector. The power connector comprises an insulative housing 10' and a number of power contacts 20' received in the insulative housing 10'.

However, each of the power contacts 20' has an irregular shape that is difficult to manufacture by lathe turning or die casting. The power contacts has many irregulars such as difficult to manufacture, waste time, waste material, high coast, and can't to be replaced etc. Each of the power contacts 20' has a number of barbs, and is fixed to the insulative housing 10' through the barbs interference fit with insulative housing 10' so that the engagement area of the insulative housing 10' has been destroyed and the power cables 210' may be pulled out. If the power contacts 20' are replaced by new power contacts, the retention force between the new power contacts and the insulative housing 10' may not be enough. Thereby, it is necessary to replace the power connector. Additionally, when the power connector assemble is used in a strict environment such as moisture, high temperature, low temperature etc, the performance of the insulative housing 10' may be changed that may result in decline the retention force between the power contact 20' and the insulative housing 10'. Hence, it is disable to design a power connector assembly to overcome problems mentioned above.

BRIEF SUMMARY OF THE INVENTION

Accordingly, an object of the present invention is to provide a power contacts which is easy to be replaced.

Another object of the present invention is to provide a power connector has at least one power contact which is easy to be replaced.

Another object of the present invention is to provide a power connector assembly having at least one power contact which is easy to be replaced.

In order to achieve the above-mentioned object, a power connector comprises an insulative housing, and at least one power contact received in the insulative housing. The at least one power contact comprises a base, a mating conductor received in the base, and a fixing mating for fixing the mating conductor, the base and the insulative housing together. The base defines a mounting hole extending along a first direction, and a fixing hole in communication with the mounting hole and extending along a second direction perpendicular to the first direction. The mating conductor comprises a mating portion for electrically mating with a mating power contact, and an opposite mounting portion inserted into the mounting hole. The mounting portion defines an opening hole extending along the second direction. The fixing member is inserted into the opening hole and the fixing hole to fix the mating conductor, the base and the insulative housing together.

In order to achieve the above-mentioned object, a power connector assembly comprises a power connector, and at least one power cable connected with the power connector. The at least one power contact comprises a base, a mating conductor received in the base, and a fixing mating for fixing the mating conductor, the base, the insulative housing, and the at least one power cable together. The at least one power cable comprises a central conductor and an insulative layer enclosing the central conductor. The base defines a mounting hole extending along a first direction, and a fixing hole in communication with the mounting hole and extending along a second direction perpendicular to the first direction. The mating conductor comprises a mating portion for electrically mating with a mating power contact, and an opposite mounting portion inserted into the mounting hole. The mounting portion defines an opening hole extending along the second direction. The fixing member is inserted into the opening hole and the fixing hole to fix the mating conductor, the base, the insulative housing and the at least one cable together.

In order to achieve the above-mentioned object, a power contact comprises a base, a mating conductor received in the power contact, and a fixing member for fixing the power and the mating conductor together. The base defines a mounting hole extending along a first direction, and a fixing hole in communication with the mounting hole and extending along a second direction perpendicular to the first direction. The mating conductor comprises a mating portion for electrically mating with a mating power contact, and an opposite mounting portion inserted into the mounting hole. The mounting portion defines an opening hole extending along the second direction. The fixing member is inserted into the opening hole and the fixing hole to fix the mating conductor and the base together.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
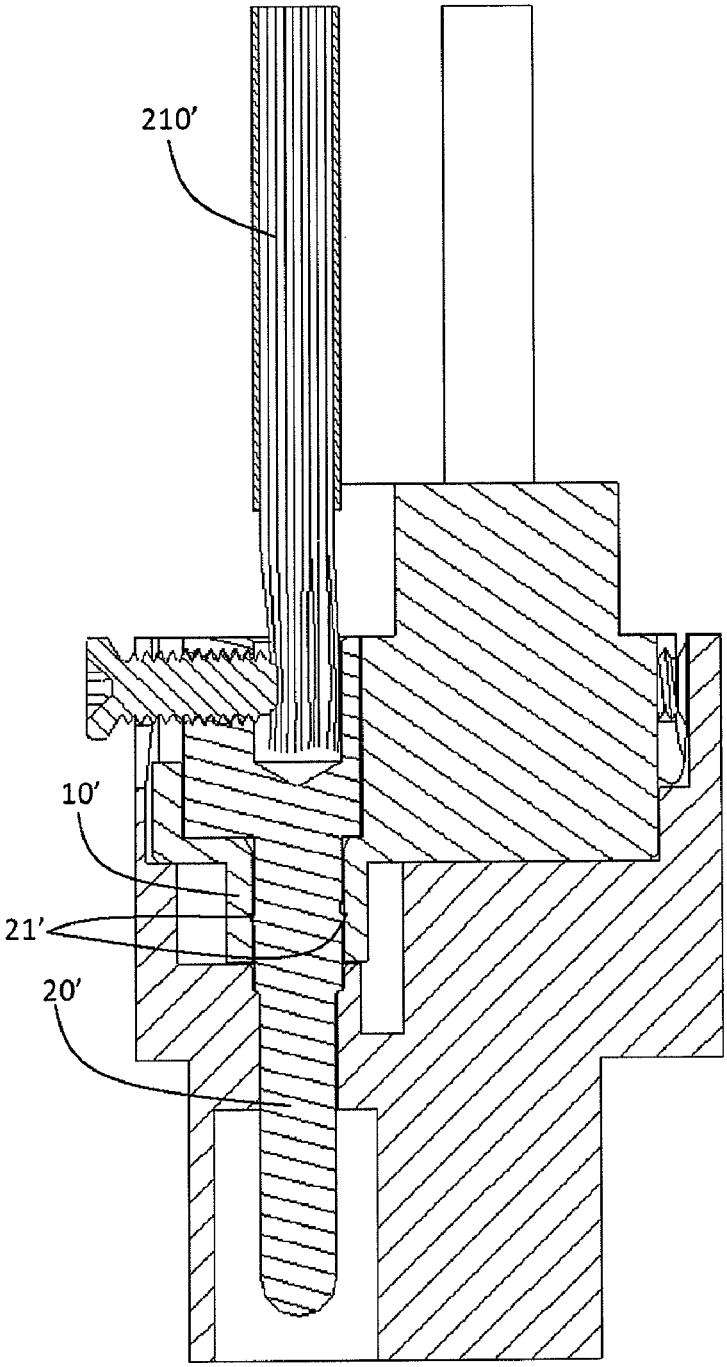
FIG. 1 is an assembled, perspective view of a conventional power connector assembly.

In the following description, numerous specific details are set forth to provide a thorough understanding of the present invention. However, it will be obvious to those skilled in the art that the present invention may be practiced without such specific details. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
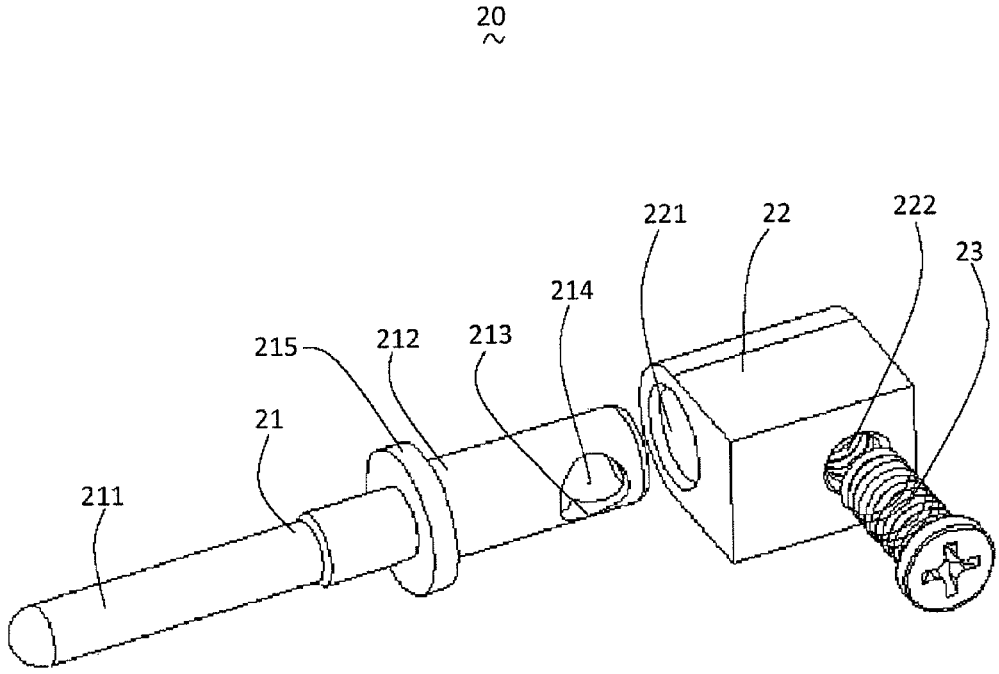
FIG. 2 is an exploded, perspective view of a power contact in accordance with the present invention.
Figure 3:
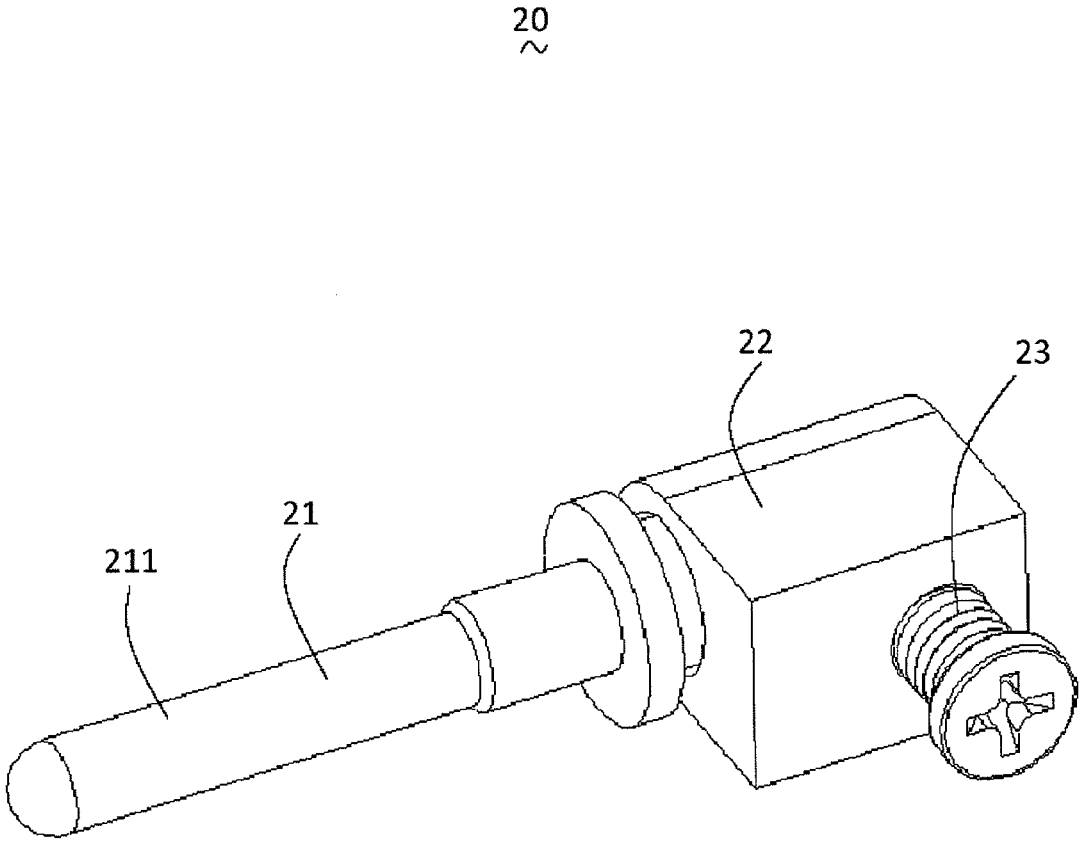
FIG. 3 is an assembled, perspective view of a power contact of FIG. 2.
Figure 4:
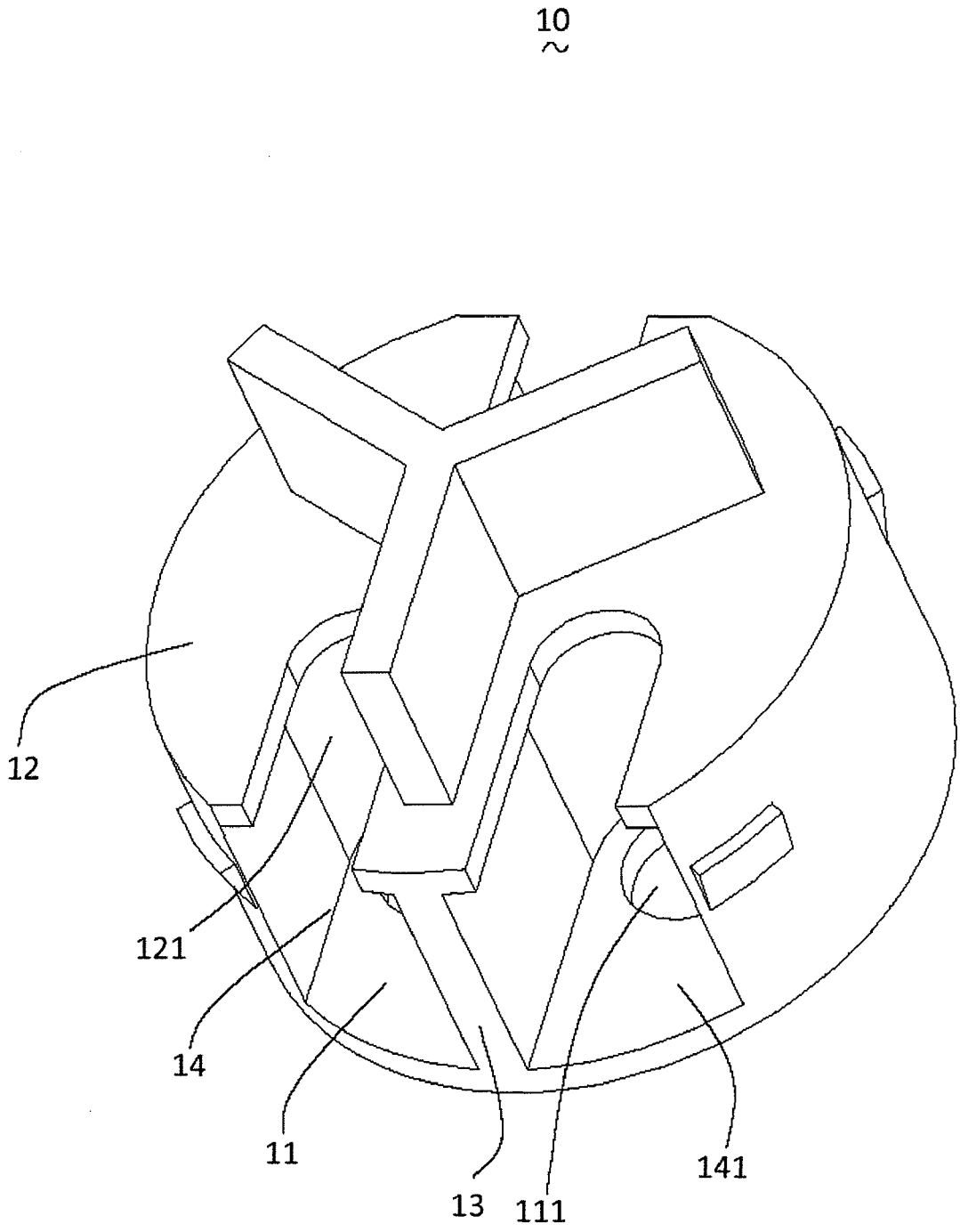
FIG. 4 is a perspective view of an insulative housing in accordance with the present invention.
Figure 5:
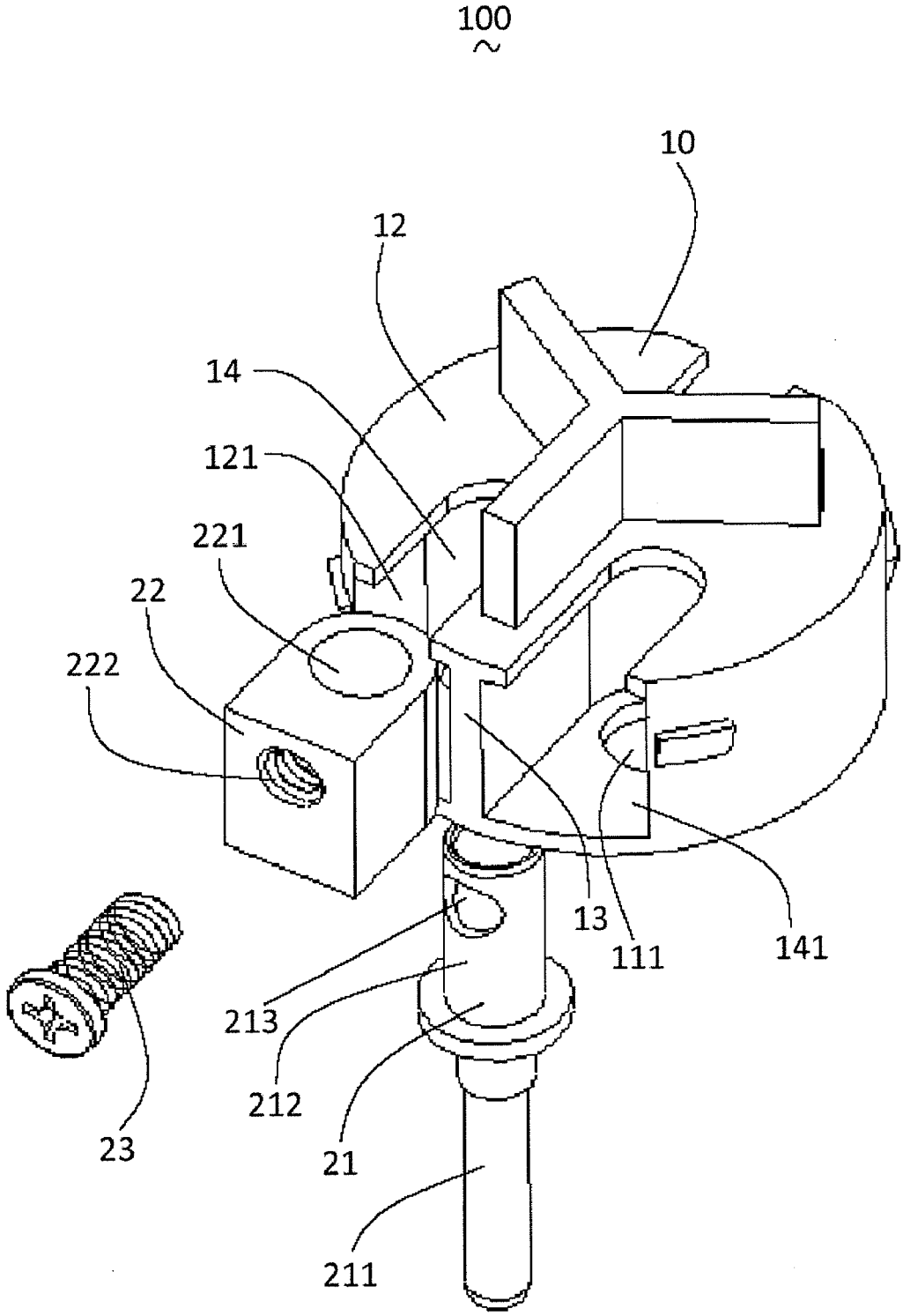
FIG. 5 is an exploded, perspective view of a power connector in accordance with the present invention.
Figure 6:
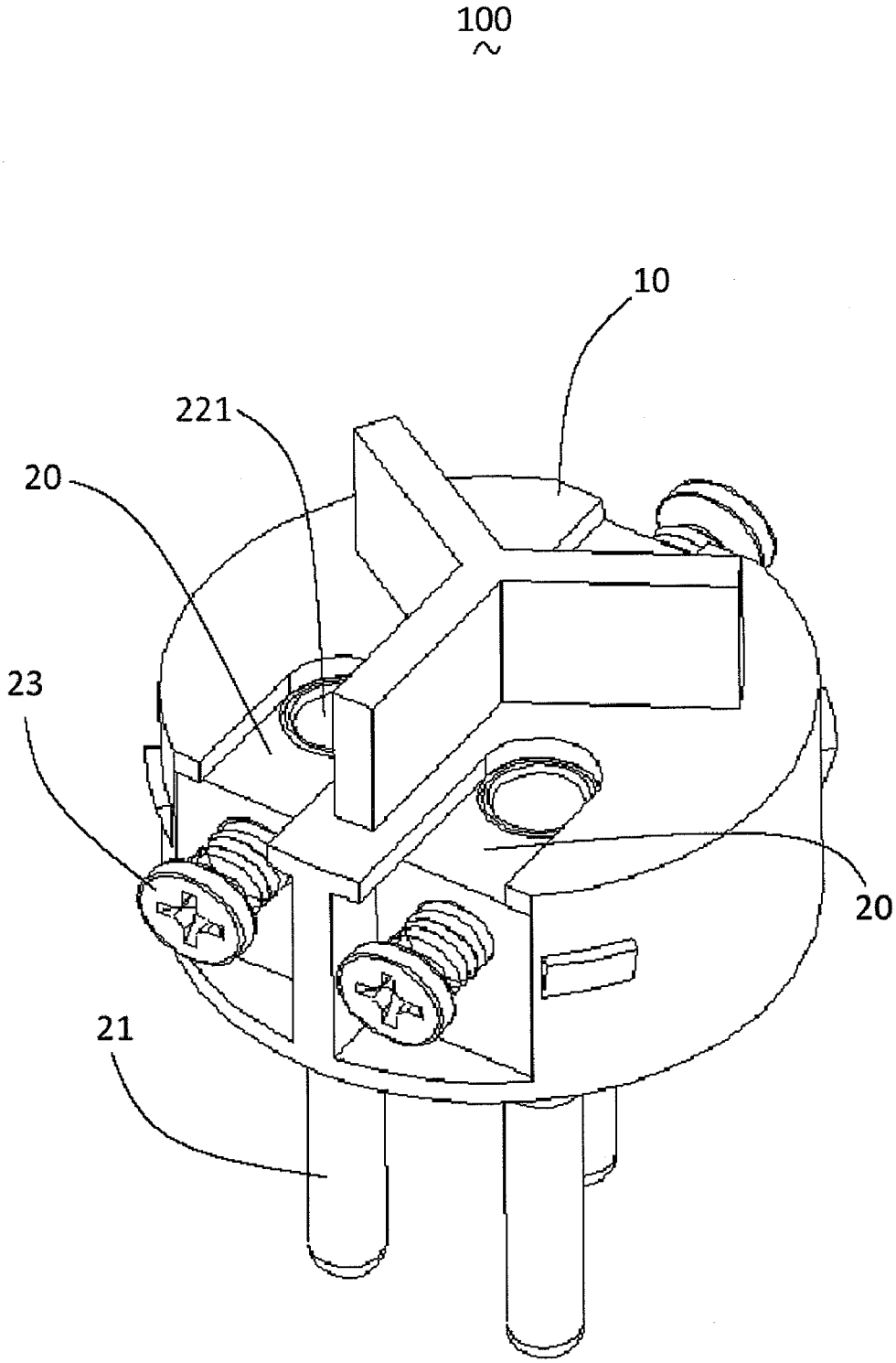
FIG. 6 is an assembled, perspective view of a power connector of FIG. 5.
Figure 7:
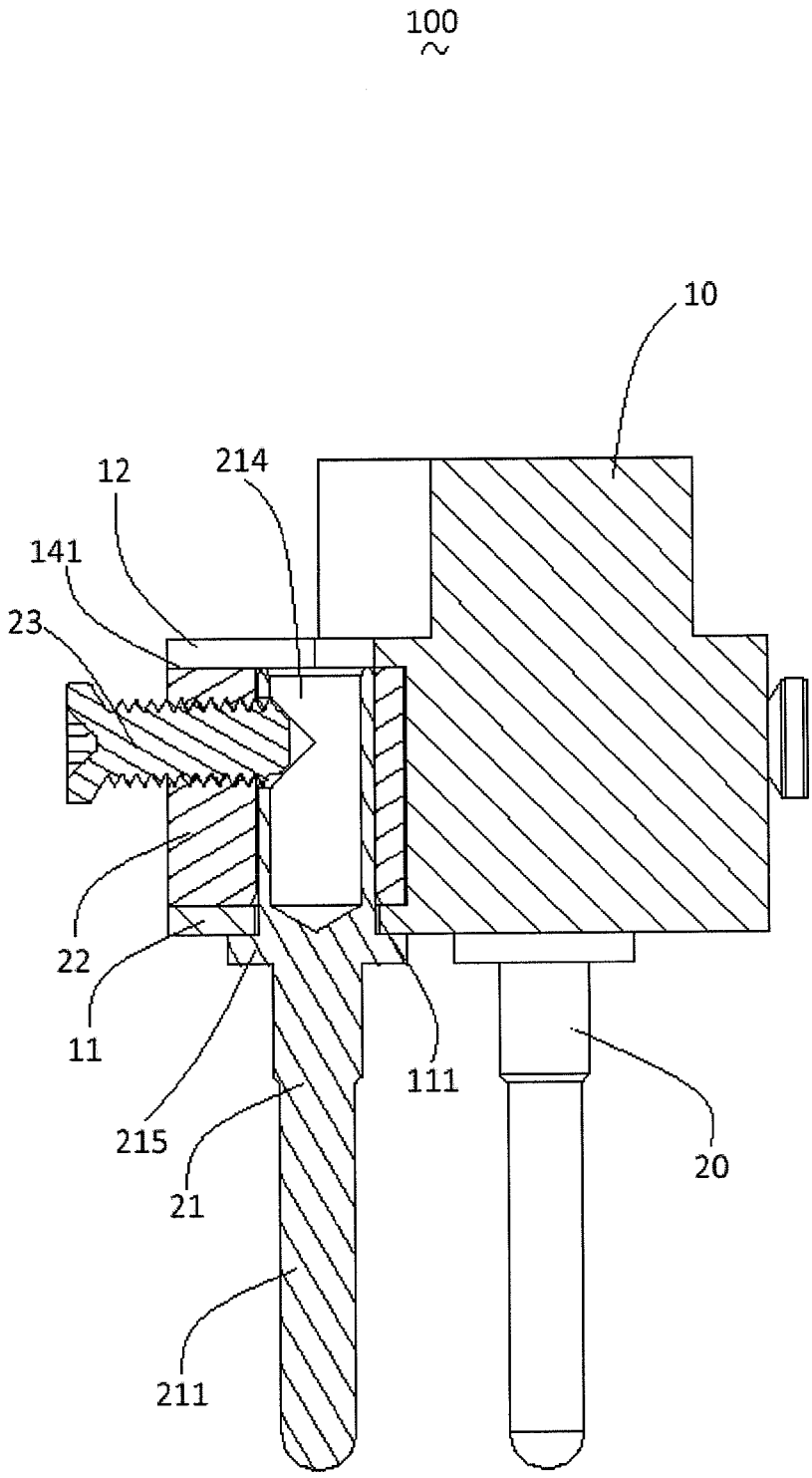
FIG. 7 is a cross-sectional view of FIG. 5 showing a power contact received in the insulative housing.

Referring to FIGS. 2 and 3, a power contact 20 in accordance with a preferred embodiment of the present invention is shown. In the preferred embodiment, the power contact 20 is a plug power contact. The power contact 20 comprises a base 22, a mating conductor 21 received in the base 22 and a fixing member 23 for fixing the mating conductor 21 and the base 22 together. The base 22 defines a mounting hole 221 extending along a first direction (longitudinal direction) and a fixing hole 222 in communication with the mounting hole 221 and extending along a second direction (transverse direction) perpendicular to the first direction. The mating contact 21 comprising a mating portion 211 for electrically mating with a mating power contact (not shown), and an opposite mounting portion 212 inserted into the mounting hole 221. The mounting portion 212 defines an opening hole 213 extending along the second direction. The fixing member 23 is inserted into the opening hole 213 and the fixing hole 222 to fix the mating conductor 21 and the base 22 together.

Referring to FIGS. 2 and 3, in the preferred embodiment, the fixing member 23 may be a screw. The fixing hole 222 may be a screwed hole. The fixing member 23 screws with the fixing hole 222 to fix the mating contact 21 and the base 22 together. The mounting portion 212 of the mating conductor 21 further comprises a receiving hole 214 in communication with the opening hole 213 and extending along the first direction for receiving a power cable, and a projection portion 215 disposed between the mating portion 211 and the mounting portion 215. The dimension of the projection portion 215 is larger than the dimension of the mating portion 211 and the mounting portion 212. The mounting hole 221 extends through the base 22 along the first direction. The base is made of metallic material and manufactured by die casting or aluminium extruded. The mounting portion 212 has a loose fit with the mounting hole 221. Therefore, it is expediently to mount the mating conductor 21 to the base 22 and to replace the power contact 20.

Referring to FIGS. 2-7, a power connector 100 in accordance with a preferred embodiment of the present invention is shown. In the preferred embodiment, the power connector 100 comprises an insulative housing 10 and at least one power contact 20 as described above received in the insulative housing 10. In this embodiment, there are three power contacts 20 are received in the insulative housing 10. In option, any number of power contact 20 may be used.

Referring to FIGS. 4-7, the insulative housing 10 comprises a front wall 11, a rear wall 12 parallel to and spaced apart from the front wall 11, at least one receiving room 14 disposed between the front wall 11 and the rear wall 12, and a side opening 141 in communication with the at least one receiving room 14 and along the second direction. The front wall 11 defines a front opening 111 in communication with the at least one receiving room 14. The rear wall 12 defines a rear opening 121 in communication with the at least one receiving room. A power cable may be inserted in the mounting hole 221 of the base 22.

Referring to FIGS. 4-7, in this embodiment, there are three power contacts 20, three receiving room 14 for receiving the power contacts 20 respectively. The insulative housing 10 comprising three inner walls 13 disposed between the adjacent receiving rooms 14 respectively. The insualtive housing 10 defines three side opening 141 each in communication with the corresponding receiving room. The front wall 11 defines three front opening 111 each in communication with the corresponding receiving room 14. The rear wall 12 defines three rear opening 121 each in communication with the corresponding receiving room 14. However, any number of receiving room 14 may be defined. The number of the front opening 111, the rear opening 121 and the side opening 141 are equal to the number of the receiving room 14.

Referring to FIGS. 4-7, the base 22 is inserted into the at least one receiving room 141 from the side opening 141 and received into the receiving room 14. The mounting portion 212 of the mating conductor 21 is inserted in the mounting hole 221 of the base 22. The projection portion 215 of the mating conductor 21 abuts against the front wall 11 of the insulative 10. The opening hole is aligned with the fixing hole 222. The fixing member 23 is inserted into the side opening 214, the opening hole and the fixing hole 222 to fix the mating conductor 21, the base 22 and the insulative housing together. The front wall 11 of the insulative housing 10 is sandwiched between the base 22 and the projection portion 215 of the mating conductor 21. The mating conductor 21 can't be pulled out, when an out force along the first direction is applied to the mating conductor 21.

The mating conductor 21 of the power contact 20 is discrete from the base 22 of the power contact 20. Therefore, the power contact 20 is steadily received in the insulative housing 10 and easy to assembly the power connector 100. The power contact 20 is not interference with the insulative housing 10. Therefore, is it easy to replace the power contact 20.

Referring to FIGS. 2-9, a power connector assembly 1 in accordance with a preferred embodiment of the present invention is shown. In the preferred embodiment, the power connector assembly 1 comprises a power connector 100 as described above, and a power cable 200 connected with the power connector 100.

Figure 8:
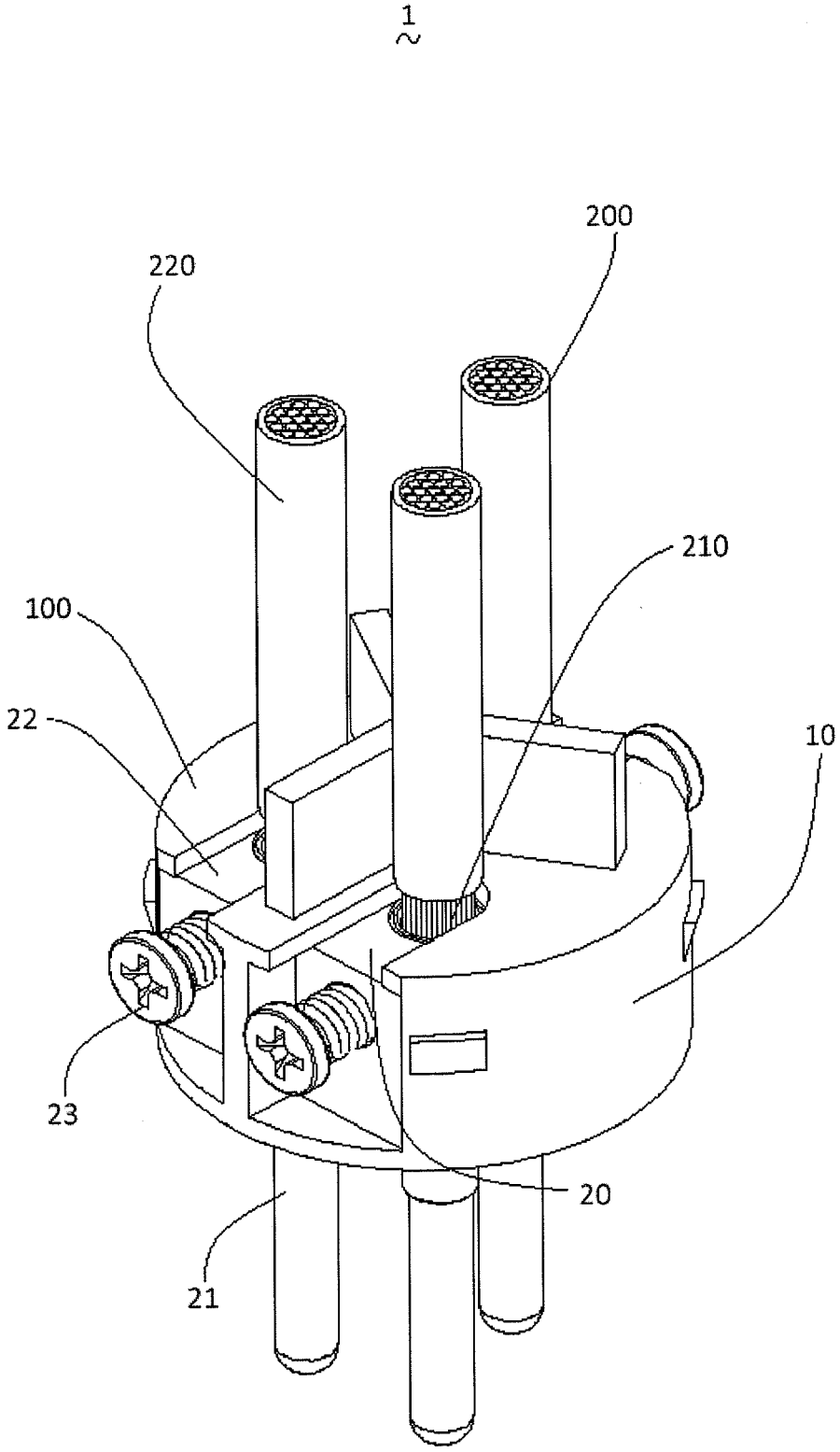
FIG. 8 is an assembled, perspective view of a power connector assembly in accordance with the present invention.
Figure 9:
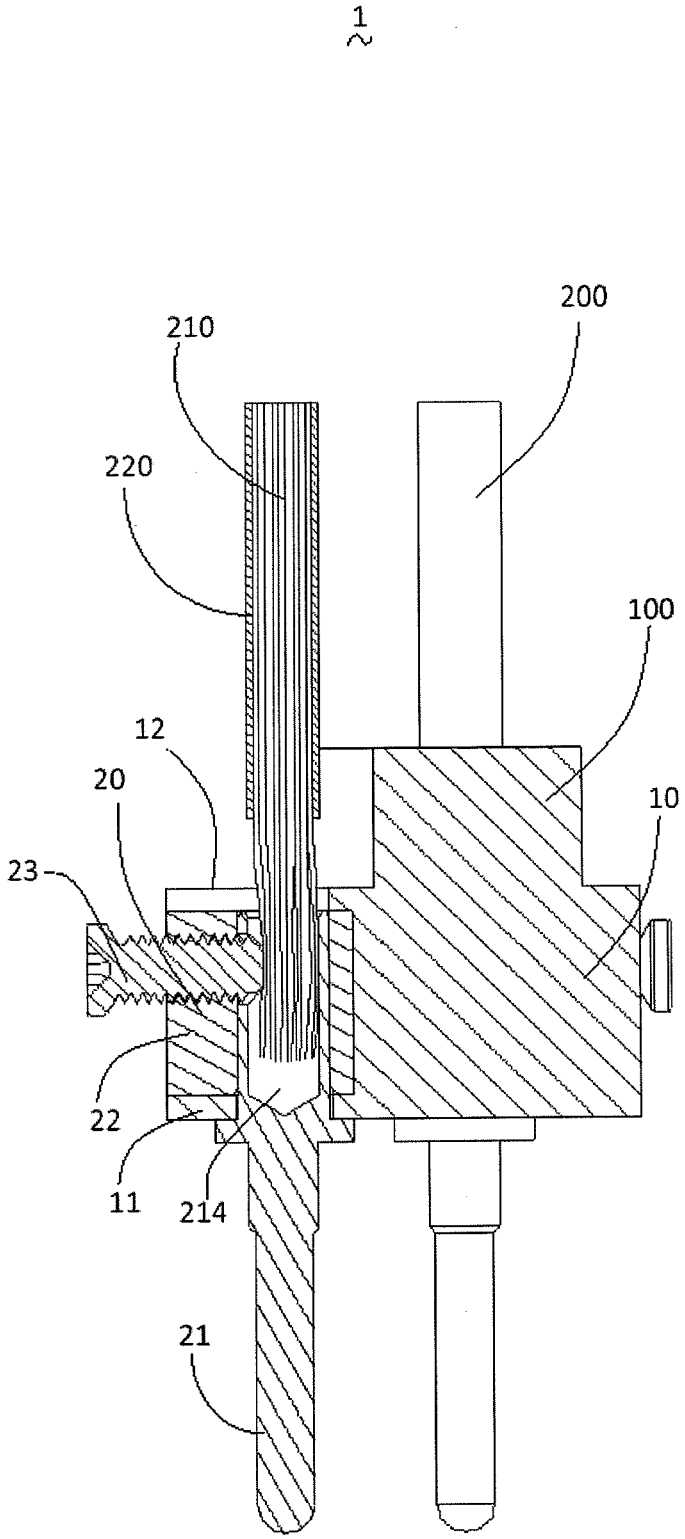
FIG. 9 is a cross-sectional view of FIG. 8 showing a power contact and a power cable received in the insulative housing.

Referring to FIGS. 8 and 9, the power cable comprises a central conductor 210, and an insulative layer 220 enclosing the central conductor 210. a portion of the central conductor 210 is received in the receiving hole 214 of the mounting portion 212. The power cable 200 is steadily received in the power connector 100, when the fixing member 23 is mounted. In this embodiment, there are three power cables 200. However, any number of power cable 200 may be used.

The performance of the power contact 20 may be deteriorated, when the power cable assembly is used in a strict environment such as high temperature, moisture etc. It is easy to change the power contact 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A power connector comprising:

an insulative housing comprising a receiving room, a front wall defining a front opening in communication with the receiving room, and a side opening in communication with the receiving room;

at least one power contact received in the insulative housing, comprising:

a base defining a mounting hole extending along a first direction, and a fixing hole in communication with the mounting hole and extending along a second direction perpendicular to the first direction;

a mating conductor comprising a mating portion for electrically mating with a complementary power contact, and an opposite mounting portion inserted into the mounting hole, the mounting portion defining an opening hole extending along the second direction; and a fixing member inserted into the opening hole and the fixing hole to securely assemble the mating conductor, the base and the insulative housing together.

2. The power connector as claimed in claim 1, wherein the mounting portion of the at least one mating contact is inserted through the front opening and received in the mounting hole of the base, and wherein the fixing member is inserted through the side opening into the opening hole and the fixing hole to assembly the at least one power contact and the insulative housing together.

3. The power connector as claimed in claim 2, wherein said insulative housing comprises a rear wall parallel to and spaced apart from the front wall, and wherein the receiving room is defined between the front wall and the rear wall.

4. The power connector as claimed in claim 3, wherein the rear wall defines a rear opening in communication with the receiving room for a power cable inserted into the at least one receiving room.

5. The power connector as claimed in claim 2, wherein the mating conductor comprises a projection portion abutting against the front wall, and wherein the opening hole is aligned with the fixing hole.

6. The power connector as claimed in claim 5, wherein the front wall of the insulative housing is sandwiched between the base and the projection portion of the mating conductor.

7. The power connector as claimed in claim 2, wherein there are a plurality of receiving rooms and corresponding number of power conductors received in the receiving rooms respectively, and wherein the insulative housing comprises a plurality of inner walls disposed between the adjacent receiving rooms.

8. The power connector as claimed in claim 1, wherein the mounting portion of the mating conductor has a loose fit with the mounting hole of the base, the fixing member being a screw, the fixing hole being a screwed hole, the fixing member screwed with the screwed hole.

9. A power connector assembly comprising:

a power connector;

at least one power cable connected with the power connector, the at least one power cable comprising a central conductor and an insulative layer enclosing the central conductor;

the power connector comprising:

an insulative housing comprising a receiving room, a front wall defining a front opening in communication with the receiving room, and a side opening in communication with the receiving room;

at least one power contact received in the insulative housing, each of the power contacts comprising:

a base defining a mounting hole extending along a first direction, and a fixing hole in communication with the mounting hole and extending along a second direction perpendicular to the first direction;

a mating conductor comprising a mating portion for electrically mating with a mating power contact, and an opposite mounting portion inserted into the mounting hole, the mounting portion defining an opening hole extending along the second direction; and a fixing member inserted into the opening hole and the fixing hole to securely connecting the mating conductor, the base, the insulative housing and the at least one cable together.

10. The power connector assembly as claimed in claim 9, wherein the mounting portion of the mating contact is inserted through the front opening and received in the mounting hole of the base, and wherein the fixing member is inserted through the side opening into the opening hole and the fixing hole to securely connect the at least one power contact and the insulative housing together.

11. The power connector assembly as claimed in claim 10, wherein the insulative housing comprises a rear wall parallel to and spaced apart from the front wall, and wherein the receiving room is defined between the front wall and the rear wall.

12. The power connector assembly as claimed in claim 11, wherein the rear wall defines a rear opening for the at least one power cable inserted into the receiving room.

13. The power connector assembly as claimed in claim 10, wherein the mating conductor comprises a projection portion abut against the front wall, the opening hole aligned with the fixing hole.

14. The power connector assembly as claimed in claim 10, wherein there are a plurality of receiving rooms and corresponding number of power conductors received in the receiving rooms respectively, and wherein the corresponding number of power cables are received in the receiving rooms respectively, and wherein the insulative housing comprises a plurality of inner walls disposed between the adjacent receiving rooms.

15. The power connector assembly as claimed in claim 10, wherein the mating conductor comprises a projection portion, the front wall of the insulative housing sandwiched between the projection portion and the base.

16. A power contact comprising:

a base defining a mounting hole extending along a first direction, and a fixing hole in communication with the mounting hole and extending along a second direction perpendicular to the first direction;

a mating conductor comprising a mating portion for electrically mating with a complementary power contact, and an opposite mounting portion inserted into the mounting hole, the mounting portion defining an opening hole extending along the second direction; and a fixing member inserted into the opening hole and the fixing hole to fix the mating conductor to the base;

wherein the mounting hole extends through the base along the first direction;

wherein the mounting portion of the mating conductor has a loose fit with the mounting hole of the base;

wherein the fixing member is a screw.

* * * * *